US012186675B2

(12) United States Patent
Teng

(10) Patent No.: US 12,186,675 B2
(45) Date of Patent: Jan. 7, 2025

(54) AGGREGATIVE DICE SHAKER

(71) Applicant: BOLLER TECHNOLOGY CO., LTD., Hsinchu (TW)

(72) Inventor: Ho-Tien Teng, Hsinchu (TW)

(73) Assignee: BOLLER TECHNOLOGY CO., LTD., Hsinchu (TW)

( * ) Notice: Subject to any disclaimer, the term of this patent is extended or adjusted under 35 U.S.C. 154(b) by 660 days.

(21) Appl. No.: 17/460,236

(22) Filed: Aug. 29, 2021

(65) Prior Publication Data

US 2022/0203217 A1 Jun. 30, 2022

(30) Foreign Application Priority Data

Dec. 25, 2020 (TW) ..... 109146114

(51) Int. Cl.
*A63F 9/04* (2006.01)

(52) U.S. Cl.
CPC ..... *A63F 9/0406* (2013.01); *A63F 2009/0411* (2013.01)

(58) Field of Classification Search
CPC ..... A63F 9/0406; A63F 2009/0411
See application file for complete search history.

(56) References Cited

U.S. PATENT DOCUMENTS 2,693,962 A * 11/1954 Stevens ..... A63F 9/0406 273/145 D
3,350,098 A * 10/1967 Cromp ..... A63F 9/0406 200/600
7,780,166 B1 * 8/2010 Paxton ..... A63F 9/0406 273/145 C
2007/0060301 A1 * 3/2007 Lin ..... A63F 3/00157 463/22
2009/0224475 A1 * 9/2009 Hsu ..... A63F 9/0406 273/146
2010/0148437 A1 * 6/2010 Kellond ..... A63F 9/0402 273/145 C
2010/0304838 A1 * 12/2010 Nordahl ..... G07F 17/322 273/145 C
2012/0123915 A1 * 5/2012 Risnoveanu ..... G06Q 20/10 705/30
2014/0319769 A1 * 10/2014 MacDonald ..... A63F 9/0406 273/142 E
2016/0129341 A1 * 5/2016 Sahl ..... A63F 9/0468 273/142 E
2018/0085660 A1 * 3/2018 Bergant ..... A63F 9/0406

* cited by examiner

*Primary Examiner* — Eugene L Kim
*Assistant Examiner* — Christopher Glenn
(74) *Attorney, Agent, or Firm* — HESLIN ROTHENBERG FARLEY & MESITI P.C.; George S. Blasiak, Esq.

(57) ABSTRACT

An aggregative dice shaker comprises: providing two or more dice cup devices and a control device. Each dice cup device includes a dice plate, a camera, and a shaking device. A plate surface of the dice plate is for placing the dice thereon. The camera faces toward the plate surface. The shaking device applies a reciprocating force to the dice plate. The control device receives an external control signal and activating the corresponding dice cup device, and outputs the game result as an output. Therefore players can play games using one dice cup device and games using multiple dice cup devices.

6 Claims, 4 Drawing Sheets

AGGREGATIVE DICE SHAKER

CROSS REFERENCE TO RELATED APPLICATIONS

This U.S. Patent Application claims priority to Taiwan Application No.: 109146114, filed on Dec. 25, 2020, which is incorporated by reference herein in its entirety.

TECHNICAL FIELD

The present invention relates to a dice cup, and more particularly to an aggregative dice shaker.

BACKGROUND

A dice game is one of popular casino games. The dice game uses the randomness of dice points to play. To ensure the number of dice pips free from human intervention, manual dice-shaking is gradually replaced by more popular electric dice cups. "Sic Bo" in Chinese language, which means "dice treasure", is a mainstream of the dice games. There are not so many kinds of dice games because of the conventional configuration of the dice cup. Therefore, it is necessary to provide an aggregative dice shaker that allows players to play more kinds of dice games.

SUMMARY

Accordingly, one objective of the present invention is to provide an aggregative dice shaker, which allows players to play more games upon multiple dice cups.

In order to overcome the technical problems in prior art, the present invention provides an aggregative dice shaker, comprising: two or more dice cup devices, each dice cup device being assigned an identification code, each dice cup device including a dice plate, a lid, a camera and a shaking device, a plate surface of the dice plate being for placing dice thereon, the lid covering the plate surface of the dice plate, the camera, which faces toward the plate surface, being disposed between the dice plate and the lid and the shaking device being connected to the dice plate to apply a reciprocating force to the dice plate, and a control device being connected to all of the dice cup devices, the control device receiving an external control signal and activating the dice cup device having the identification code corresponding to a designated identification code according to the external control signal, and receiving a game result image from the camera of the dice cup device having the identification code corresponding to the designated identification code, and the control device determining a game result and outputting the game result as an output.

According to one embodiment of the present invention, the aggregative dice shaker is provided, wherein the shaking device includes a first shaking component and a second shaking component, the first shaking component includes a first actuator and a first support element, the first actuator is connected to the dice plate to apply a vertical reciprocating force to pivot the dice plate in a reciprocating manner about the first support element, which is functioned as a fulcrum, so as to rotate the dice plate about a first axis, the second shaking component includes a second actuator and a second support element, the second actuator is connected to the first shaking component to apply a vertical reciprocating force to pivot the first shaking component in a reciprocating manner about the second support element, which is functioned as a fulcrum, so as to rotate the first shaking component about a second axis, the first axis and the second axis are parallel with the plate surface, the first axis and the second axis are non-parallel.

According to one embodiment of the present invention, the aggregative dice shaker is provided, wherein the game result includes a pip comparison result between/among the dice cup devices.

According to one embodiment of the present invention, the aggregative dice shaker is provided, wherein the game result includes a situation which counts how many dice appear with a specific number of pips across the plurality of the dice cup devices.

According to one embodiment of the present invention, the aggregative dice shaker is provided, wherein when there are two or more dice cup devices whose identification code corresponding to the designated identification code and activated by the control device, the shaking devices of the dice cup devices whose identification code corresponding to the designated identification code operate simultaneously.

According to one embodiment of the present invention, the aggregative dice shaker is provided, wherein the number of the dice cup device is three or more.

According to one embodiment of the present invention, the aggregative dice shaker is provided, wherein the dice plate is demountable from the shaking device.

According to the technical means adopted by the aggregative dice shaker of the present invention, there are more than two dice cup devices provided in the aggregative dice shaker. The control device of the present invention could receive the external control signal, activate the dice cup device having the identification code corresponding to the designated identification code according to the external control signal, and output the game result of the dice cup devices having the identification code corresponding to the designated identification code, thereby allowing players to play various games including the game using one dice cup device and the game using a plurality of dice cup devices. Furthermore, the present invention can be applied to play different games with the dice cup device at the same time.

DETAILED DESCRIPTION OF THE PREFERRED EMBODIMENTS

The preferred embodiments of the present invention are described in detail below with reference to FIG. 1 to FIG. 4. The description is used for explaining the embodiments of the present invention only, but not for limiting the scope of the claims.

Figure 1:
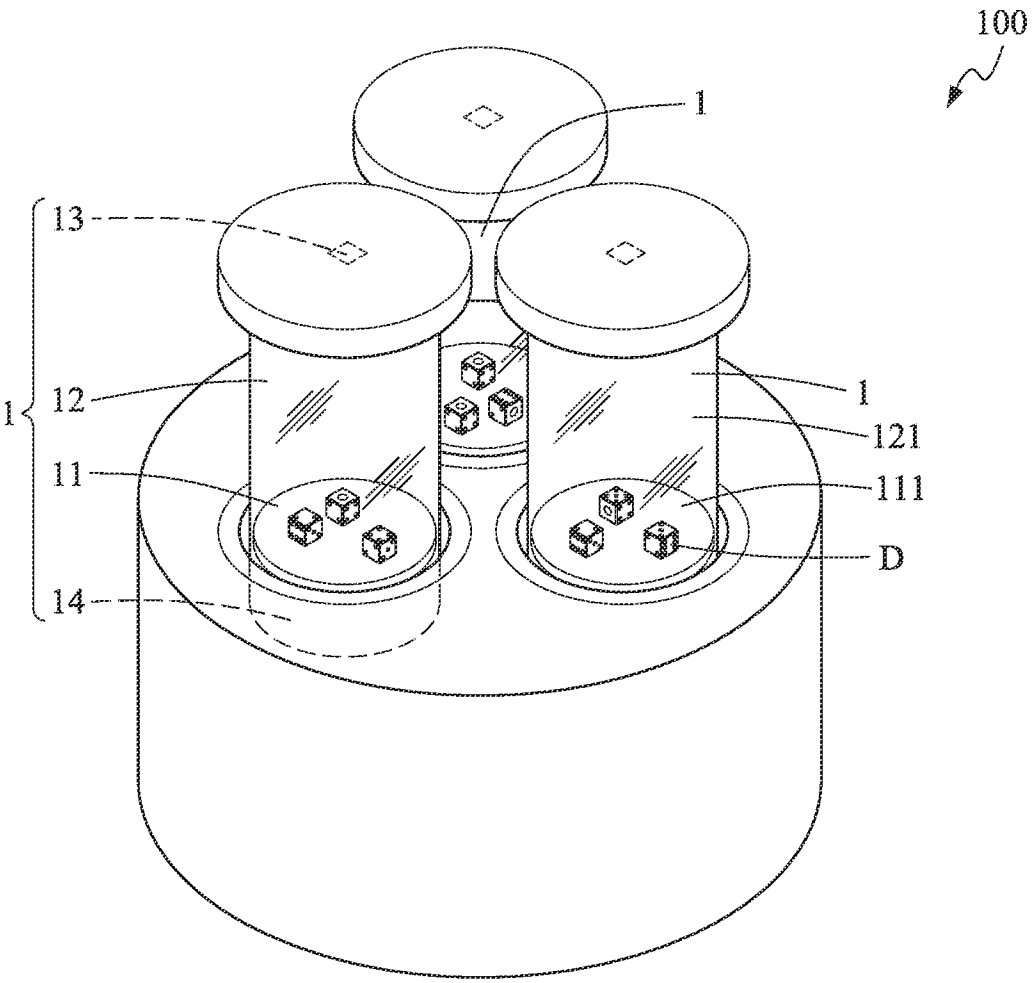
FIG. 1 is a schematic drawing illustrating an aggregative dice shaker according to an embodiment of the present invention.
Figure 2:
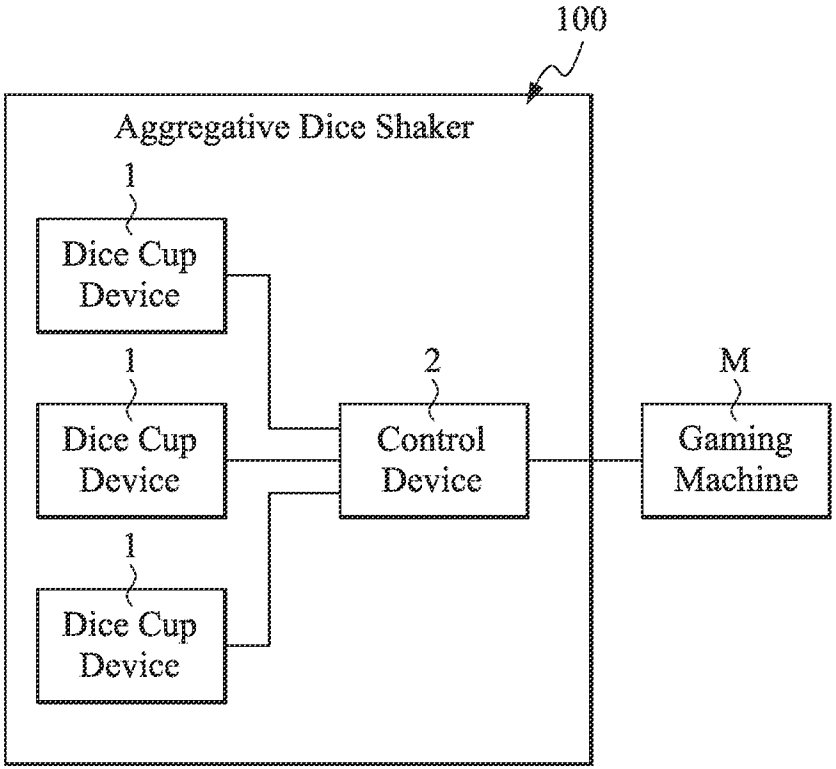
FIG. 2 is a schematic block diagram illustrating the aggregative dice shaker according to the embodiment of the present invention.

An aggregative dice shaker 100 of the present invention is for one or more gaming machines M to connect, so that players can place bet on game results of the aggregative dice shaker 100 through the gaming machines M. As shown in FIG. 1 and FIG. 2, according to one embodiment of the present invention, the aggregative dice shaker 100 comprises: two or more dice cup devices 1 and a control device 2.

The control device 2 is a microcontroller. As shown in FIG. 2, the control device 2 is connected to all of the dice cup devices 1. The control device 2 receives a control signal from the external gaming machines M and activates the corresponding dice cup device 2 according to the external control signal. Accordingly, the control device 2 can activate one or more dice cup devices 1 to allow the players to play games using one dice cup device 1, such as Sic Bo, and games using a plurality of dice cup devices 1.

Each dice cup device 1 is assigned an identification code for the control device 2 to identify each dice cup device 1 and to control the corresponding dice cup device 1 having the identification code corresponding to a designated identification code according to the external control signal.

In this embodiment, three dice cup device 1 are provided. Through the gaming machine M, the player is allowed to play Sic Bo that uses any one of the dice cup devices 1, play the game of comparing a total number of pips that uses any two of the dice cup devices 1, or play the game of counting how many dice appear with a specific number of pips across the three dice cup devices 1. It goes without saying that the number of the dice cup devices 1 is not limited to three, and the corresponding gameplay is not limited to this.

Figure 3:
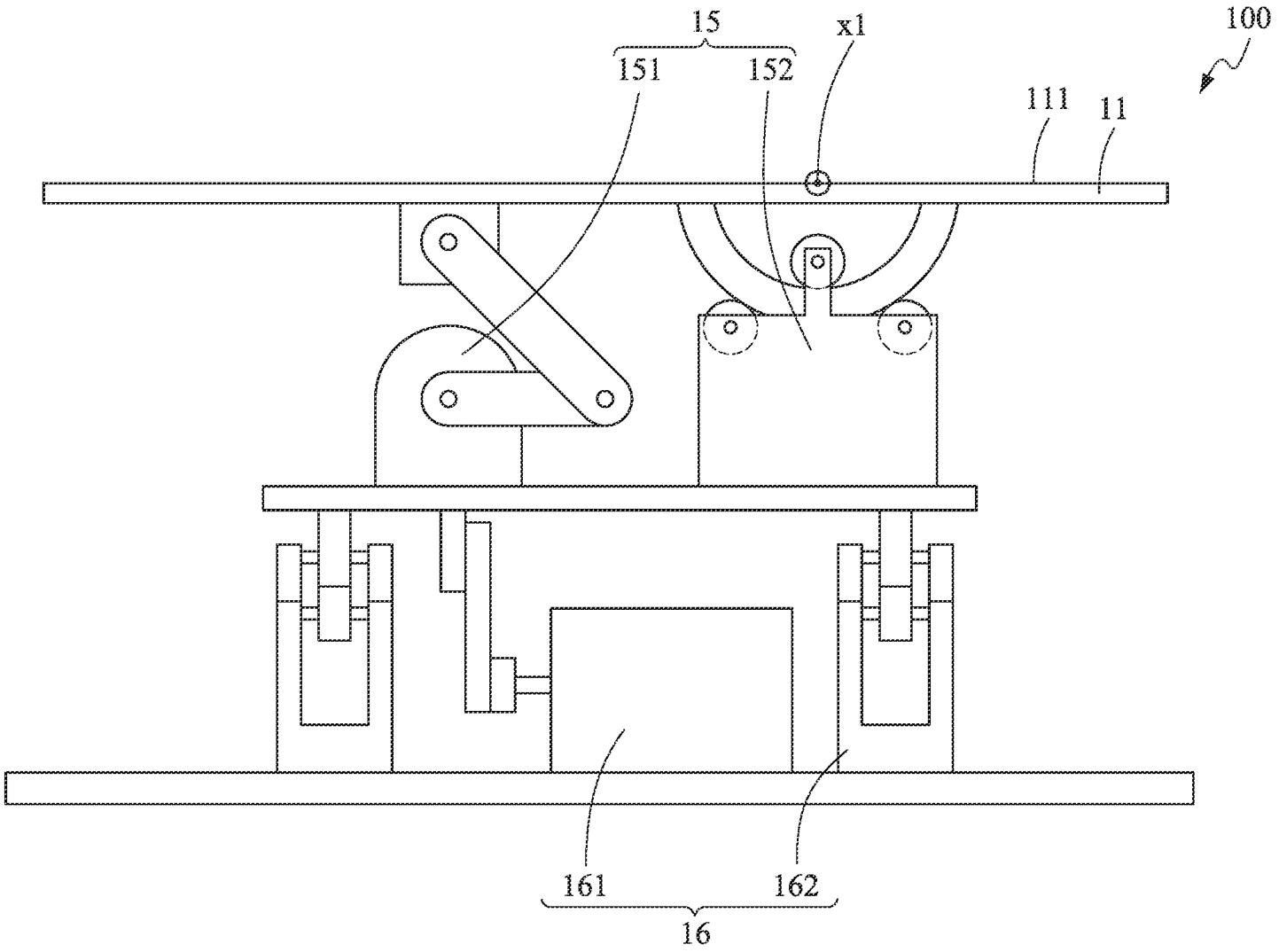
FIG. 3 is a schematic side view of a shaking device of the aggregative dice shaker according to the embodiment of the present invention.
Figure 4:
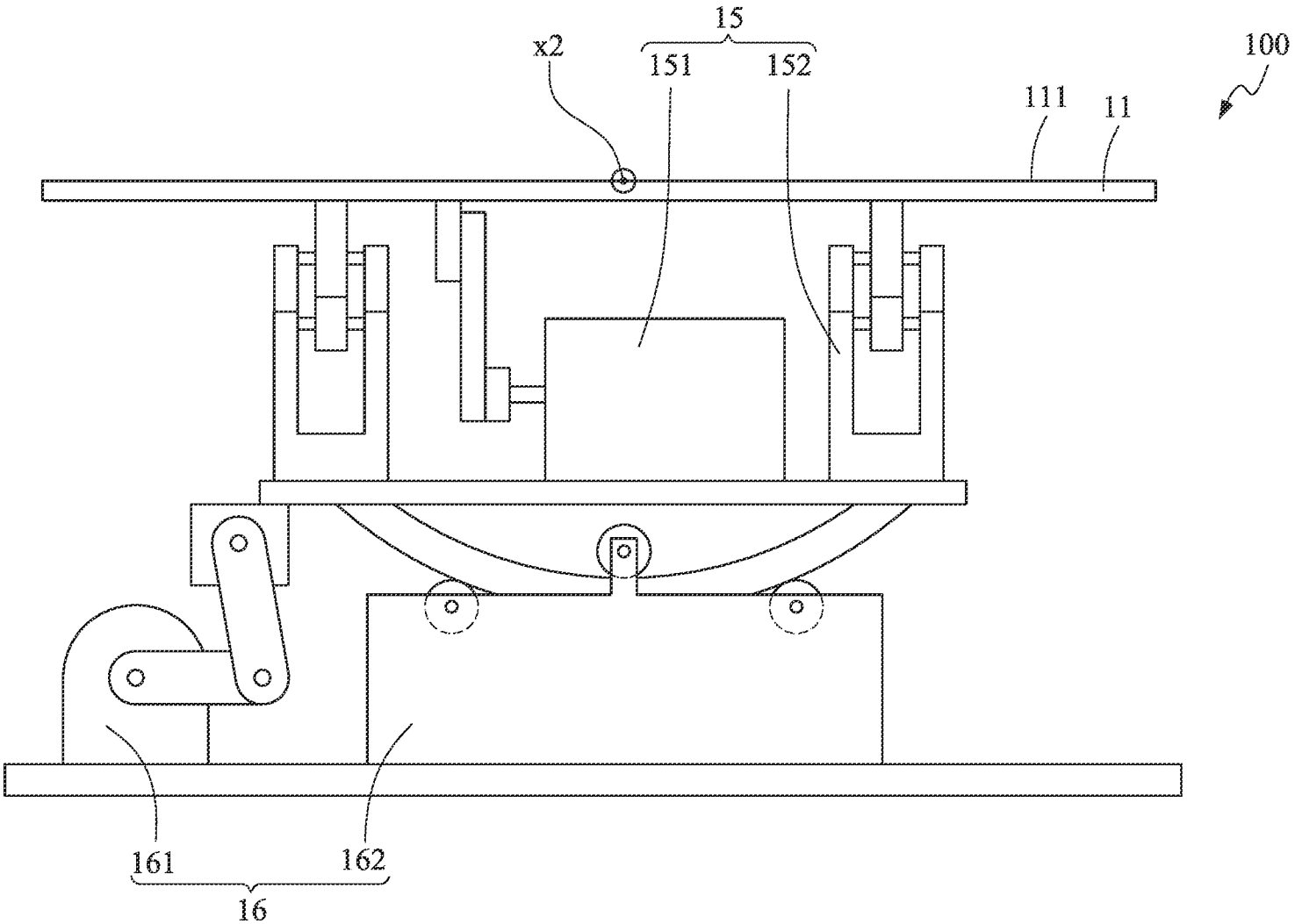
FIG. 4 is another schematic side view of the shaking device of the aggregative dice shaker according to the embodiment of the present invention.

As shown in FIGS. 1, 3 and 4, each dice cup device includes a dice plate 11, a lid 12, a camera 13, and a shaking device 14.

The dice plate 11 is a circular plate. A plate surface 111 of the dice plate 11 is for placing dice D thereon. The dice plate 11 is disposed on the shaking device 14. Each dice plate 11 can be made to be distinguishable from the appearance. In this embodiment, the plate surfaces 111 of the three dice plates 11 is respectively printed with "banker", "player one", "player two" for the players to distinguish them. The dice plates 11 are demountable from the shaking devices 14 to facilitate the maintenance or replacing the dice plate 11 with the plate surface 111 having different appearances.

The lid 12 covers the plate surface 111 of the dice plate 11 to isolate the interior from the exterior to keep the dice D away from external interferences. In this embodiment, the lid 12 includes a transparent lid 121 and an opaque lid (not shown). The transparent lid 121 is transparent for the players to inspect the number of pips of the dice D and to know the game result. The opaque lid is opaque and is capable of vertical movement via manipulation to prevent the players form knowing the game result in advance. The transparent lid 121 is an inner lid, and the opaque lid is an outer lid. In other embodiments, the lid 12 can only have the transparent lid or be visibility adjustable.

The camera 13, which faces toward the plate surface 111, is disposed between the dice plate 11 and the lid 12. The camera 13 takes a game result image containing the plate surface 111 and the dice D and transmits it to the control device 2

The control device 2 receives the game result image from the camera 13 of the dice cup device 1 having the identification code corresponding to the designated identification code, and identifies the number of pips appearing on each dice D according to the game result image. The control device 2 can outputs the number of pips of each dice D as the game result to the external gaming machine M. In addition, the control device 2 can also perform calculations based on the number of pips of dice D of the dice cup device 1, for example, comparing the total number of pips of the dice D between different dice cup devices 1, or counting how many dice appear with a specific number of pips across the plurality of the dice cup devices 1. Therefore, the game result includes the pip comparison result between/among the dice cup devices 1 and/or the number of dice D appearing with the specific number of pips across the plurality of the dice cup devices 1. In other embodiments, according to the game requirements, the control device 2 can also identify the position, the color, etc. of each dice D based on the game result image.

When there are more than one dice cup devices whose identification code corresponding to the designated identification code and activated, the control device 2 controls the shaking devices 14 of the dice cup devices 1 whose identification code corresponding to the designated identification code operate simultaneously. In other embodiments, the control device 2 may control the shaking devices 14 to operate sequentially.

In this embodiment, the game result output by the control device 2 includes the number of pips of the dice D, a pip comparison result between/among the dice cup devices 1 and a situation which counts how many dice appear with a specific number of pips across the plurality of the dice cup devices.

The shaking device 14 is connected to the dice plate 11 to apply a reciprocating force to the dice plate 11. As shown in FIG. 3 and FIG. 4, the shaking device 14 includes a first shaking component 15 and a second shaking component 16. The first shaking component 15 is disposed at the bottom of the dice plate 11. The second shaking component 16 is disposed at the bottom of the first shaking component 15. The first shaking component 15 rotates the dice plate 11 about a first axis x1. The second shaking component 16 rotates the dice plate 11 about a second axis x2.

The first axis x1 and the second axis x2 are non-parallel to one another. Accordingly, when the first shaking component 15 and the second shaking component 16 operate simultaneously, the dice cup device 1 would have complex movements. In other embodiments, the shaking device 14 applies a force to the dice plate 11 such that the dice plate 11 may shake in the vertical direction.

The first shaking component 15 includes a first actuator 151 and a first support element 152. The first actuator 151 is connected to the dice plate 11 to apply a vertical reciprocating force to pivot the dice plate 11 in a reciprocating manner about the first support element152 which is functioned as a fulcrum, so as to rotate the dice plate 11 about the first axis x1. The first actuator 151 includes a motor and a connecting rod, and in other embodiments, the first actuator 151 can be a force applying device such as a cam motor, an electric cylinder, a hydraulic cylinder or a pneumatic cylinder.

, The second shaking component 16 includes a second actuator 161 and a second support element 162. The second actuator 161 is connected to the first shaking component 15 to apply a vertical reciprocating force to pivot the first shaking component 15 in a reciprocating manner about the second support element 162, which is functioned as a fulcrum, so as to rotate the first shaking component 15 about the second axis x2. The second actuator 161 includes a motor and a connecting rod, and in other embodiments, the second actuator 161 can be a force applying device such as a cam motor, an electric cylinder, a hydraulic cylinder or a pneumatic cylinder.

The first axis x1 and the second axis x2 are parallel with the plate surface 111. In this embodiment, the first axis x1 and the second axis x2 are perpendicular to one another. In FIG. 3 and FIG. 4, the first axis x1 and the second axis x2 are respectively indicated by a symbol "⊙" representing a direction perpendicular to the plane of the paper. In this embodiment, both the first axis x1 and the second axis x2 are located at the plate surface 111. In other embodiments the first axis x1 and the second axis x2 also can be parallel with the plate surface 111 with an altitude different from the plate surface 111.

The above description should be considered as only the discussion of the preferred embodiments of the present invention. A person having ordinary skill in the art may make various modifications to the present invention. However, those modifications still fall within the spirit of the present invention and the scope defined by the appended claims.

What is claimed is:

1. An aggregative dice shaker, comprising:

two or more dice cup devices, each dice cup device being assigned an identification code; each dice cup device including a dice plate, a lid, a camera and a shaking device; a plate surface of the dice plate being for placing dice thereon; the lid covering the plate surface of the dice plate; the camera, which faces toward the plate surface, being disposed between the dice plate and the lid; and the shaking device being connected to the dice plate to apply a reciprocating force to the dice plate; and a control device being connected to all of the dice cup devices; the control device receiving an external control signal and activating the dice cup device having the identification code corresponding to a designated identification code according to the external control signal; and receiving a game result image from the camera of the dice cup device having the identification code corresponding to the designated identification code; and the control device determining a game result and outputting the game result as an output, wherein the shaking device includes a first shaking component and a second shaking component, the first shaking component includes a first actuator and a first support element, the first actuator is connected to the dice plate to apply a vertical reciprocating force to pivot the dice plate in a reciprocating manner about the first support element, which is functioned as a fulcrum, so as to rotate the dice plate about a first axis, the second shaking component includes a second actuator and a second support element, the second actuator is connected to the first shaking component to apply a vertical reciprocating force to pivot the first shaking component in a reciprocating manner about the second support element, which is functioned as a fulcrum, so as to rotate the first shaking component about a second axis, the first axis and the second axis are parallel with the plate surface, the first axis and the second axis are non-parallel.

2. The aggregative dice shaker of claim 1, wherein the game result includes a pip comparison result between/among the dice cup devices.

3. The aggregative dice shaker of claim 1, wherein the game result includes a situation which counts how many dice appear with a specific number of pips across the dice cup devices.

4. The aggregative dice shaker of claim 1, wherein when there are two or more dice cup devices whose identification code corresponding to the designated identification code and activated by the control device, the shaking devices of the dice cup devices whose identification code corresponding to the designated identification code operate simultaneously.

5. The aggregative dice shaker of claim 1, wherein the number of the dice cup device is three or more.

6. The aggregative dice shaker of claim 1, wherein the dice plate is demountable from the shaking device.

* * * * *